US012680295B2

(12) United States Patent
Rudge

(10) Patent No.: US 12,680,295 B2
(45) Date of Patent: Jul. 14, 2026

(54) CONNECTOR WITH A RECEIVING FIN

(71) Applicant: Pauline Nicola Rudge, Glen Ellen, CA (US)

(72) Inventor: Pauline Nicola Rudge, Glen Ellen, CA (US)

( * ) Notice: Subject to any disclaimer, the term of this patent is extended or adjusted under 35 U.S.C. 154(b) by 147 days.

(21) Appl. No.: 18/533,494

(22) Filed: Dec. 8, 2023

(65) Prior Publication Data

US 2025/0188736 A1 Jun. 12, 2025

(51) Int. Cl.
*E04B 1/38* (2006.01)
*E04B 1/26* (2006.01)
*E04B 1/58* (2006.01)

(52) U.S. Cl.
CPC ..... *E04B 1/388* (2023.08); *E04B 1/2604* (2013.01); *E04B 1/5831* (2013.01); *E04B 2001/2616* (2013.01); *E04B 2001/266* (2013.01); *E04B 2001/5868* (2013.01)

(58) Field of Classification Search
CPC ..... E04B 1/388; E04B 1/2604; E04B 1/5831; E04B 2001/2616; E04B 2001/266; E04B 2001/5868
See application file for complete search history.

(56) References Cited

U.S. PATENT DOCUMENTS 3,495,857 A 2/1970 Hawke et al.
4,398,841 A 8/1983 Kojima et al.
4,885,883 A 12/1989 Wright
4,910,939 A 3/1990 Cavanagh
5,435,110 A 7/1995 Stol et al.
7,883,296 B2 * 2/2011 Meyer ..... E02D 17/04 405/283
8,627,632 B2 * 1/2014 Werner ..... B21C 23/10 52/653.1
11,174,630 B2 * 11/2021 Bowron ..... E04B 1/2604
11,828,056 B2 11/2023 Styrc et al.
2006/0193687 A1 * 8/2006 Ghosh ..... E04B 1/2604 403/401
2010/0054869 A1 * 3/2010 Meyer ..... E02D 17/04 405/282

(Continued)

FOREIGN PATENT DOCUMENTS

DE 2453917 A1 11/1974
EP 0591127 A1 4/1994

(Continued)

OTHER PUBLICATIONS

Written Opinion of International Searching Authority dated Feb. 5, 2025, for PCT/US2024/058855.

*Primary Examiner* — Rodney Mintz
(74) *Attorney, Agent, or Firm* — Jacob M. Ward; Ward Law Offices LLC

(57) ABSTRACT

The present invention relates to a connector comprising: a body with at least one guide for receiving an edge of a sheet of material and at least two sockets for each receiving an end of a length of material. Each socket opens in a different direction. There is at least one slot extending axially along a wall of each socket a to permit a tool to be inserted through the slot to engage with the elongate length of material and at least one hole through the wall of each socket for passage of a securing means to prevent axial movement of the elongate length of material.

18 Claims, 13 Drawing Sheets

(56) References Cited

U.S. PATENT DOCUMENTS

| | | | | |
|---|---|---|---|---|
| 2011/0286121 | A1 | 11/2011 | Werner et al. | |
| 2018/0135295 | A1* | 5/2018 | Bowron | E04B 1/2604 |
| 2022/0034079 | A1* | 2/2022 | Styrc | E04B 1/2608 |
| 2025/0188736 | A1 | 6/2025 | Rudge | |

FOREIGN PATENT DOCUMENTS

| | | | |
|---|---|---|---|
| EP | 1395714 | A1 | 3/2004 |
| EP | 1511668 | A1 | 3/2005 |
| EP | 1896669 | A1 | 3/2008 |
| EP | 3585209 | A1 | 1/2020 |
| FR | 2470892 | | 12/1979 |
| GB | 871309 | | 9/1958 |
| GB | 910183 | A | 11/1962 |
| GB | 2118587 | A | 11/1983 |
| GB | 8706830 | | 4/1987 |
| GB | 2182112 | A | 5/1987 |
| GB | 8523360 | A | 5/1987 |
| GB | 9018315 | | 10/1990 |
| GB | 9609087 | | 7/1996 |
| GB | 9901076 | | 3/1999 |
| GB | 2395207 | A | 11/2002 |
| GB | 201413531 | | 9/2014 |
| GB | 2619138 | A | 11/2023 |
| KR | 20130134591 | A | 12/2013 |
| KR | 20130134691 | A | 12/2013 |
| WO | 02095153 | A1 | 11/2002 |
| WO | 2004013426 | A1 | 2/2004 |
| WO | 2006078642 | A2 | 7/2006 |
| WO | 2016178637 | A1 | 11/2016 |
| WO | 2018152624 | A1 | 8/2018 |

* cited by examiner

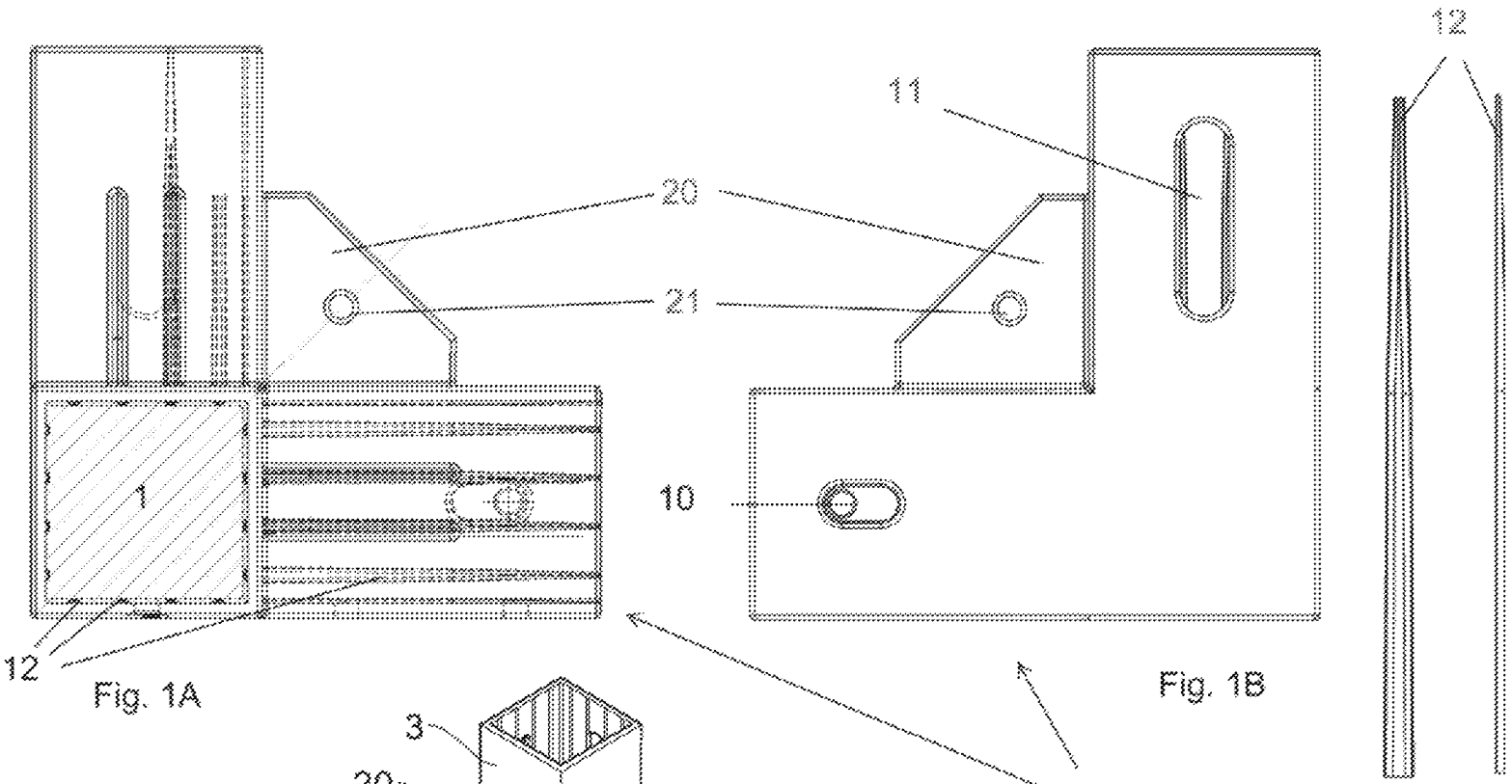
Fig. 2A Fig. 2B
Fig. 1B
Fig. 1A
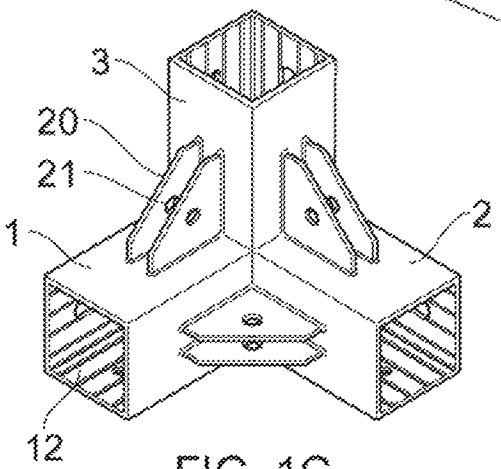
FIG. 1C

CONNECTOR WITH A RECEIVING FIN

CROSS REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

The present invention relates to a connector or a set of connectors that together are used to form modular frames, in particular a connector or set of connectors for connecting elongate members; more particularly but not exclusively battens, lengths of timber, synthetic plastics, recycled material such as plastic lumber, or metal.

BACKGROUND

Many people wish to assemble structures temporarily, for example large structures and/or structures formed of rigid members such as timber lengths, for example as modular or frame-based structures.

However this can be problematic as existing joints between lengths, for example of timber, can be fiddly, flimsy, or heavy, and difficult to assemble, single-use and/or prone to damage when disassembled.

PRIOR ART

GB 2014 13 531 (JOHNSON) discloses a connector comprising a hollow body defining an internal space, a first opening through which a first elongate article can be received in the internal space, a second opening through which a second elongate article can be received in the internal space, and a plurality of engaging formations on the inside of the hollow body for engaging the first and second articles.

GB 8 523 360 (WATTS) discloses a connection member for elongate timbers comprises at least two socket members formed as sections of hollow tubing and connected together with their axes perpendicular.

GB 8 71 309 (LEAPMAN) discloses a joint for connecting pieces of timber one to another in the construction of buildings.

FR2470892 (GUILLAUDMOND) discloses couplings for beams.

WO02/095153 (DU PREEZ) discloses a connector for connecting two lengths of timber.

The present invention arose in order to overcome problems suffered by existing devices.

SUMMARY OF THE INVENTION

According to a first aspect of the present invention there is provided a connector comprising: a body with at least one guide for receiving an edge of a sheet of material and at least two sockets for each receiving an end of a length of material, each socket opening in a different direction; at least one slot extending axially along a wall of each socket a to permit a tool to be inserted through the slot to engage with the elongate length of material and at least one hole through the wall of each socket for passage of a securing means to prevent axial movement of the elongate length of material.

In this way lengths of material can be arranged between connectors to form a modular framework. The lengths of material may be of various different materials depending on the structure to be formed. For example the lengths of material may be wood or formed from synthetic plastics, metal, metal alloy or carbon fiber.

In some embodiments at least one socket may include one or more internal ribs to locate and fix the ends of lengths of material in the socket. The ribs may be provided on all or some of the walls, or parts of each wall that form the socket. For example ribs may be provided on opposed faces of a rectangular socket rather than all faces, thereby reducing material required to form the connector and thereby also reducing the weight of the connector. It is appreciated that in some embodiments, some or all ribs may extend to the body.

Each socket is an opening defined by a wall that receives an end of a length of material.

The sockets extend from the body in different directions so that ends of lengths of materials project in different directions. For example, the sockets may extend in opposed directions, or in orthogonal directions, or in different angles or orientations to each other. In this way frameworks of different shapes can be made.

One or more slot is provided in the wall of each socket in order to enable a tool such as screw driver to pass through the slot and engage with the length of material to urge the end into the socket during assembly and out from the socket during disassembly.

The socket wall also has at least one hole for receiving a securing means such as a screw, or nail, or locking key or other fixing. For example in some embodiments a hexagonal screw key is provided that can easily put in hexagonal headed screws, similar to Allen keys. Or in some embodiments a locking key is provided to fix the end of the length of material to the connector. For example a locking key may be provided for the hole so that it can be tightened by hand, without requirements of tools, such as a butterfly handle or similar.

It is appreciated that slots and/or holes may be provided on one or more side of the socket. Ideally a slot or hole is positioned where easily accessible so that a tool can be easily used.

For example in some such embodiments the slot is located in a short side of a rectangular socket to provide effective purchase for sliding movement of the lengths of material. It is also appreciated that the lengths of material may have pre-made indentations for receiving a securing means to further help guide positioning of the length of material and ease of assembly.

The connector has at least one guide for receiving an edge of a sheet of material. In this way a sheet of material can be easily fitted to a connector to extend across an area between lengths of material. For example, such as plywood boards or a sheet of mesh.

In a preferred embodiment the guide is formed by at least two parallel sections that define a channel for holding an edge of a sheet of material. In this way the edge of the sheet of material can be slotted between the sections and held in place. It is appreciated that the edge of the sheet of material includes a corner of the sheet.

In some embodiments the guide may be formed from three or more parallel sections to define multiple channels for separate sheets of material. For example there may be four parallel sections that provide three channels to receive two sheets of plywood arranged either side of a sheet of insulation. In this way an insulated wall can be formed.

The channels created by the guide may be of different widths to accommodate different materials. For example in some embodiments the channel may be 3 mm to receive cardboard, and in some embodiments the channels may be 6 mm to receive plywood.

A guide may be provided on one or more location on the outer face of the socket and/or body. For example for a square or rectangular socket guides may be provided on one, two, three or four of the sides. In this way, with more guides on different faces, more complex modular assemblies can be formed.

In a preferred embodiment the guide has at least one aperture for receiving a securing means. This allows the sheet of material to be fixed to the connector by the guide. For example a screw, a tie or a bolt may be used to connect the sheet to the guide. These apertures are also designed to be used as tie holes to support other materials such as fabric tied to the apertures by string or wire.

In preferred embodiments the connector is formed as a single part. For example, in a preferred embodiment the connector may be injection molded to form a single part. It is appreciated that in some embodiments the connector may be formed from two or more parts.

Preferably the connectors are formed from recycled synthetic plastics, but it is appreciated that the connectors may be made from many other suitable materials.

In some embodiments the body is shaped to provide a fixed angle between the at least two sockets. In this way the orientation of the sockets is fixed, for example at right angles so that two lengths of material extend at for example 90 degrees with respect to each other. It is appreciated that the sockets may open at any other pre-defined angle for creating different modular designs.

In another embodiment the body has at least one articulated joint to adjust the angle between the sockets. In this way sockets can move in more than one axis and a user can select and adjust orientation of the sockets to increase the number of modular frameworks that can be formed from use of one connector.

Preferably each articulated joint has a locking means to selectively lock the angle between the sockets. For example the locking means may be a threaded key or handle that is used to prevent movement at the articulating joint.

In one embodiment the articulated joint has two contacting faces that each have a raised and lowered surfaces and a tighten able locking means to bring the contacting faces together, so they are locked in position. As the contacting faces come together, they engage and cannot articulate with respect to each other.

The connectors may have sockets of different shapes to accommodate different lengths of material. For example the sectional profile of each socket may be rectangular, square, or round. The dimension may also match standard materials such as lengths of batten.

In some embodiments the socket opening is tapered to help guide an end of the length of material into the socket. For example the socket may be wider at the distal end and taper to a narrower cross section at the proximal end so that the end engages with the inner surface of the socket more completely when it is fully inserted to the socket.

In some embodiments each rib may vary in depth and or width. For example the depth of the rib may increase from the distal end of the socket to the proximal end of the socket so that the end engages with the ribs more tightly when the end is fully inserted to the socket.

In some embodiments the socket includes a stopper plate or stopper to limit entry of the end of the length of material into the socket. For example, in some embodiments a closed end is created by the body so that the length of material can only be received a fixed distance into the socket. Or in an alternative embodiment an inner face of the body has a ridge or lip that blocks the length of material from passing through. Advantageously the ridge or lip may reduce the weight of the connector, rather than having a complete close end provided by a stopper plate.

The connector may be provided as a kit of parts including at least two connectors, at least one length of material, and/or at least one sheet of material.

Some preferred embodiments of the invention will now be described by way of example only and with reference to the Figures in which:

DESCRIPTION OF THE DRAWINGS

FIGS. 1A, 1B, 1C show an embodiment of a connector with three sockets;

FIGS. 2A and 2B show an example of a rib;

DETAILED DESCRIPTION OF THE PREFERRED EMBODIMENT

Figure 3A:
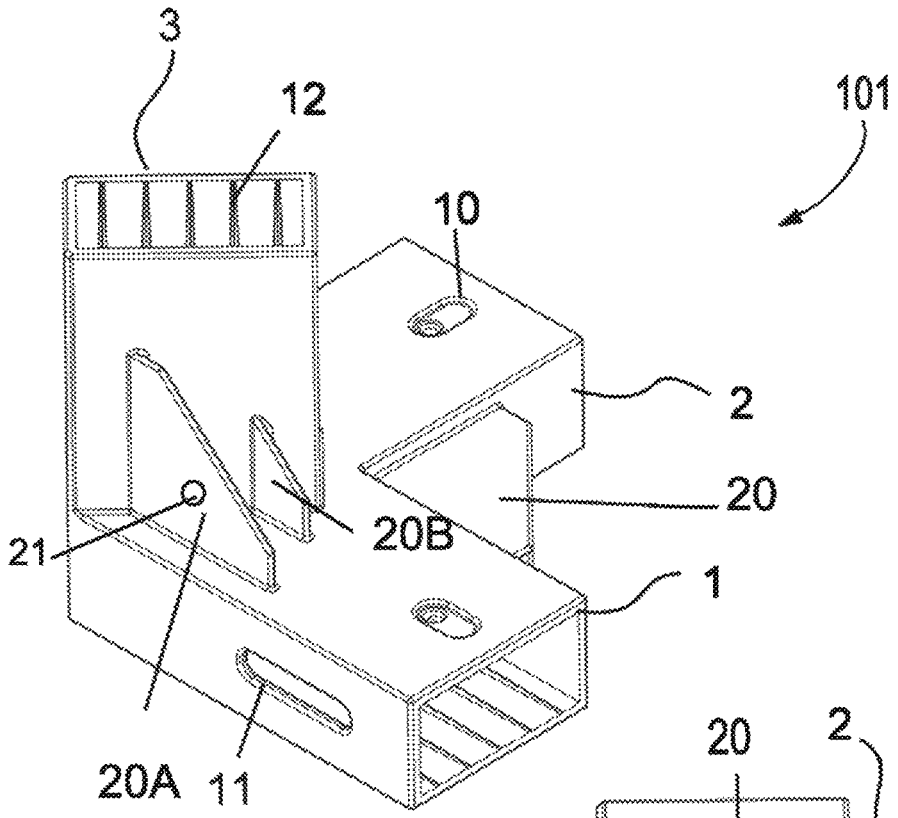
FIGS. 3A, 3B, 3C shows isometric views of a connector with three sockets.

The Figures show various embodiments of connectors 100, 101, 102, 200, 300, 400, 401, 500, 600, 601 that can be used together to form a modular framework using lengths and sheets of material.

Each embodiment has at least two sockets 1, 2, 3, 4 that extend from a body 50.

Each socket 1, 2, 3, 4 has at least one slot 11 through a wall of the socket to enable movement of an end of a length of material, such as plank or batten, into and out of the socket 1, 2, 3, 4 by use of a tool to engage with the material and urge it to or from the socket. It is appreciated that the slots may be provided on any part of the wall of the socket.

The sockets 1, 2, 3, 4 have internal ribs 12 extending axially from the opening towards to body 50 to grip the end of the length of material that is inserted.

FIGS. 2A and 2B show an example of a rib 12. FIG. 2A shows a top view of the rib 12 which has a tapered distal tip that is at the opening of the socket 1, 2, 3, 4 and the rib 12 widens towards the body 50. In FIG. 2B there is a side view of the rib 12 which shows how depth of the rib 12 tapers from the proximal end to the distal end where the rib 12 is of a shallower depth. This configuration helps to guide an end of a length of material through the opening so that it engages tightly with the proximal ends of the ribs 12.

Holes 10 are provided on the sockets 1, 2, 3, 4 to allow a fixed engagement of an end of a length of material to the connector. An attachment means is inserted through the hole, for example with a bespoke locking key, a nail, or a screw.

In particular reference to FIGS. 1A, 1B, 1C, 3A, 3B, 3C, 4A, 4B, 4C there are shown embodiments 100, 101, 102 with three sockets 1,2,3 extending from a body 50. The connectors 100, 101 and 102 are all formed as a single part and each socket 1, 2, 3 extends an opening in a different direction.

In all embodiments 100, 101 and 102 sockets 1 and 2 are in the same plane and extend at 90 degree angles with respect to each other. The third socket 3 extends in a second plane. In the embodiment shown in FIGS. 3A, 3B and 3C the third socket 3 is orthogonal the first plane. In FIGS. 4A, 4B and 4C the third socket 3 extends at 45 degrees with respect to the first plane.

Embodiments 100, 101, 102, 400, 600 have guides 20 for receiving an edge of a sheet of material. The guides 20 are formed from two or more planar sections that together define one or more channel for receiving a sheet of material. The guides 20 include apertures 21 that enable securement of the or each sheet of material to the connectors. The apertures 21 may also provide a securing point for other materials, for example to tie on a sheet of fabric.

The guides 20 in embodiments 100, 101, 102, 200, 400, 600 are substantially triangular and connect to outer faces of the body 50 and sockets 1, 2, 3, 4.

In FIGS. 1A, 1B and 1C the guides 20 are in pairs and are all the same shape and size. Each guide 20 has an aperture 21 through which a securing means is received to connect the sheet of material to the connector 100.

Figure 3B:
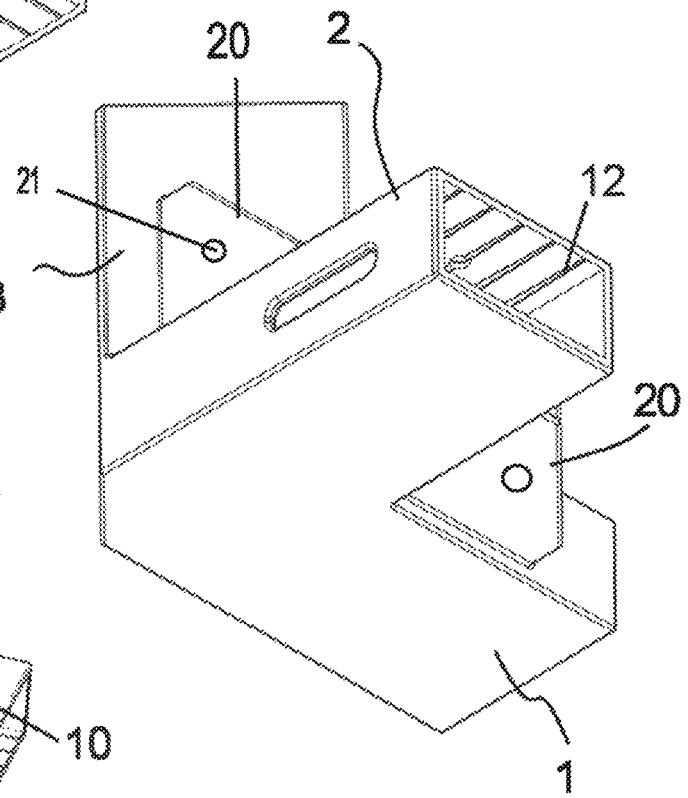
Figure 3C:
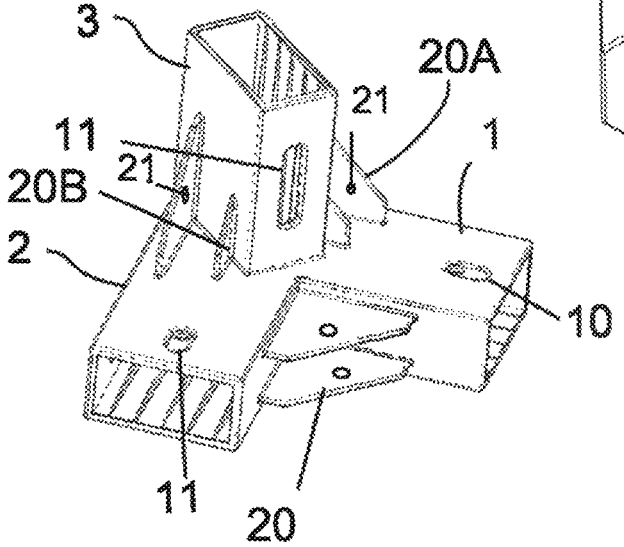
Figure 4A:
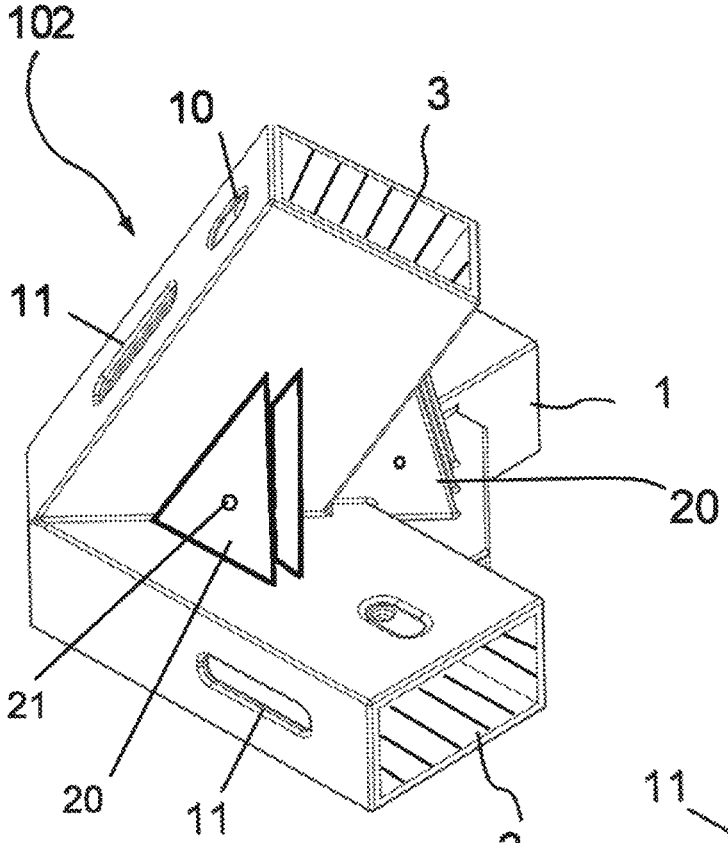
FIGS. 4A, 4B, 4C shows isometric views of a connector with three sockets.
Figure 4B:
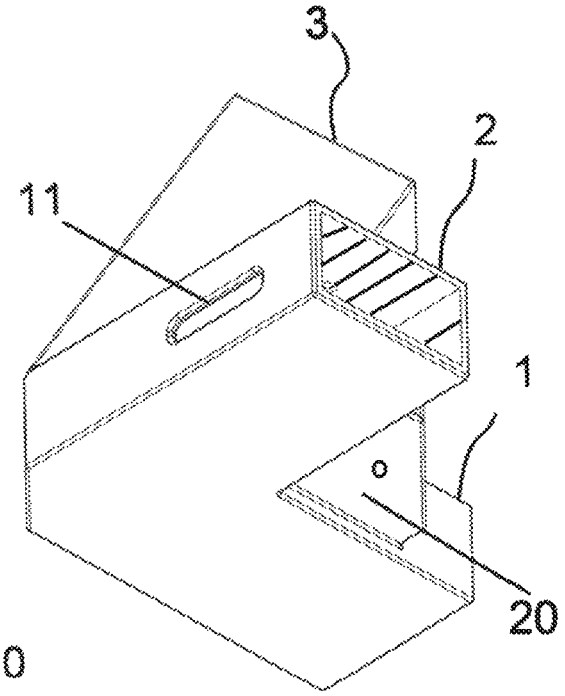
Figure 4C:
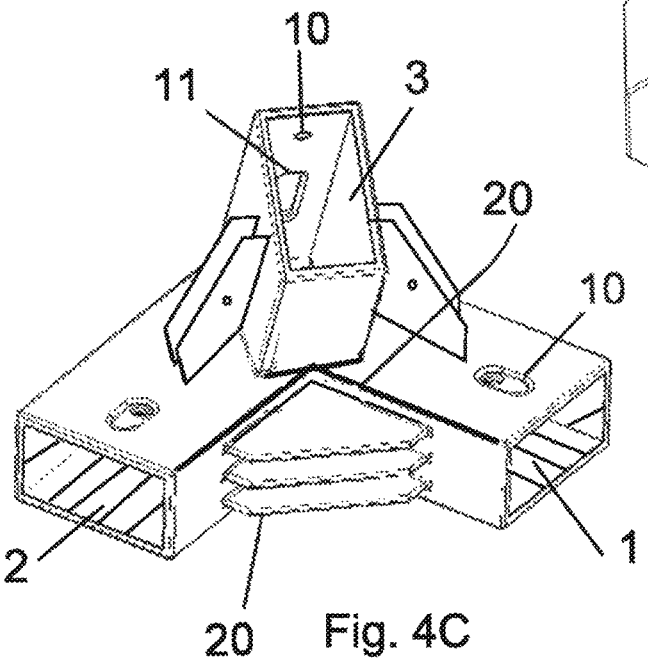
Figure 5:
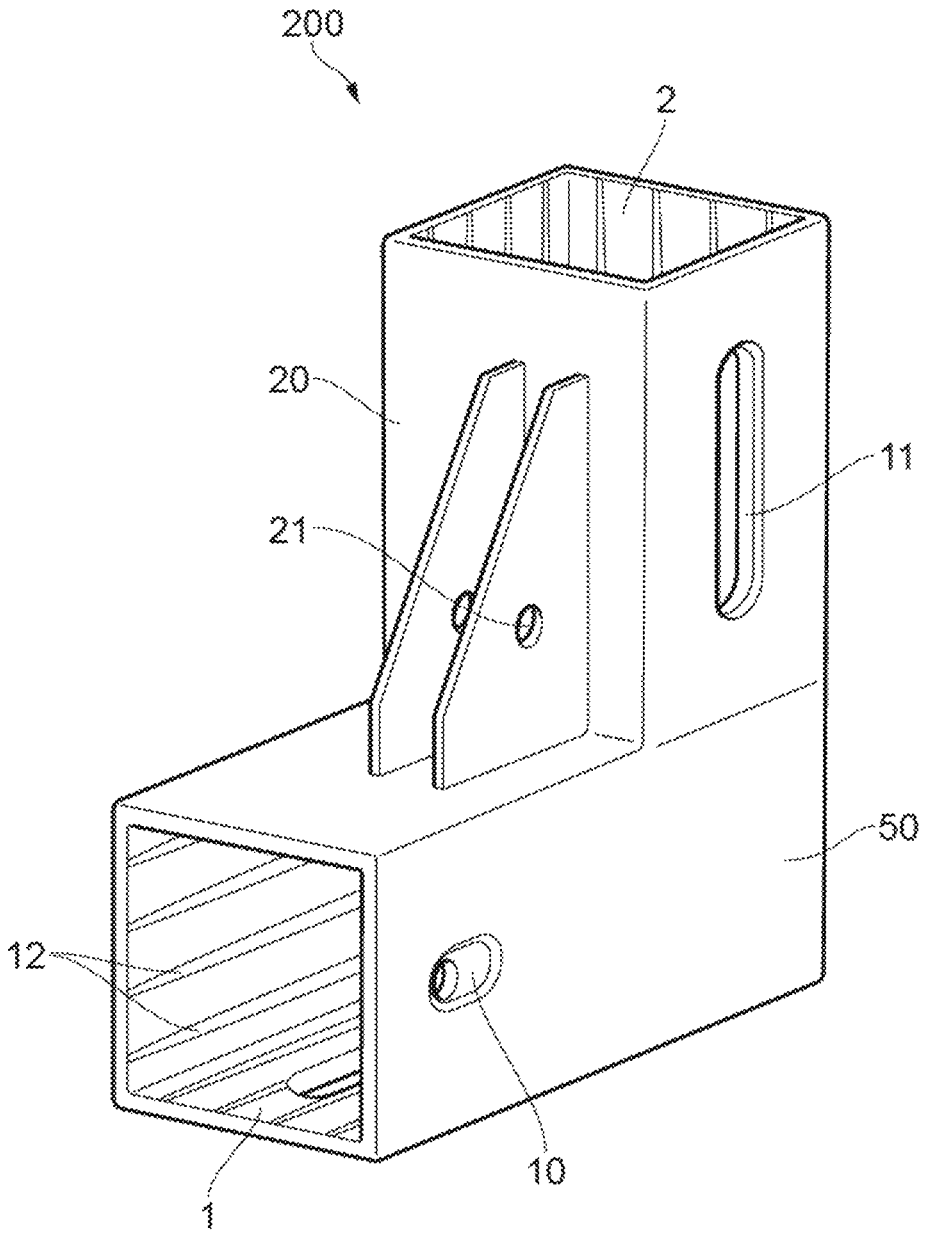
FIG. 5 shows an isometric view of an L-shaped connector.

In FIGS. 3A, 3B and 3C the guides are provided in pairs and each guide 20A, 20B that forms a pair is of a different size. In FIGS. 3A, 3B, 3C ribs 12 are provided on the wider, inner opposed faces of the sockets 1, 2, 3. It is appreciated that ribs may be provided on all or some of the walls that form the socket and that the ribs may extend to the body.

In FIGS. 4A, 4B and 4C there are three guides 20A, 20B and 20C that define two different channels so that sheets of material can be fitted in different positions, or so that two sheets can be fitted.

In FIGS. 1A, 1B, 1C, 4A, 4B, 4C, 5, 9A, 9B and 9C, 13A and 13B the guides 20 are in pairs and are all the same shape and size.

FIGS. 1A, 1B, 1C show a connector with three square sockets, 1, 2, 3. A slot 11 is provided on one face of the socket and a hole 10 is provided on a different face of the socket.

FIGS. 3A, 3B, 3C, 4A, 4B, 4C show a connector with three rectangular sockets 1, 2, 3. In FIGS. 3A, 3B and 3C a slot 11 is provided on one face of the socket and a hole 10 is provided on a different face of the socket. In FIGS. 4A, 4B and 4C socket 3 has both a slot 11 and a hole 10 on the same face.

Figure 6:
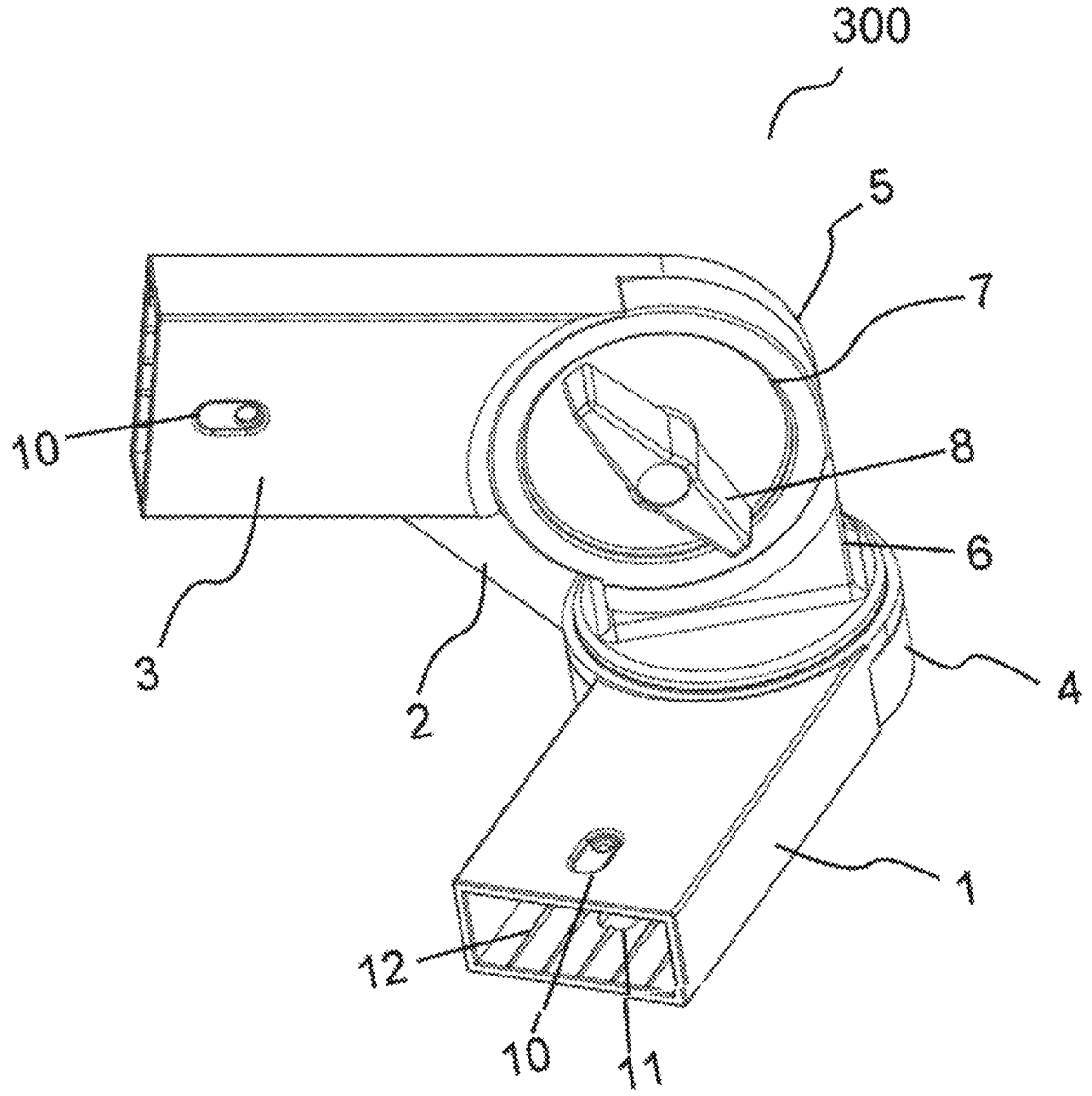
FIG. 6 shows an isometric view of a connector with an articulating joint.
Figure 7:
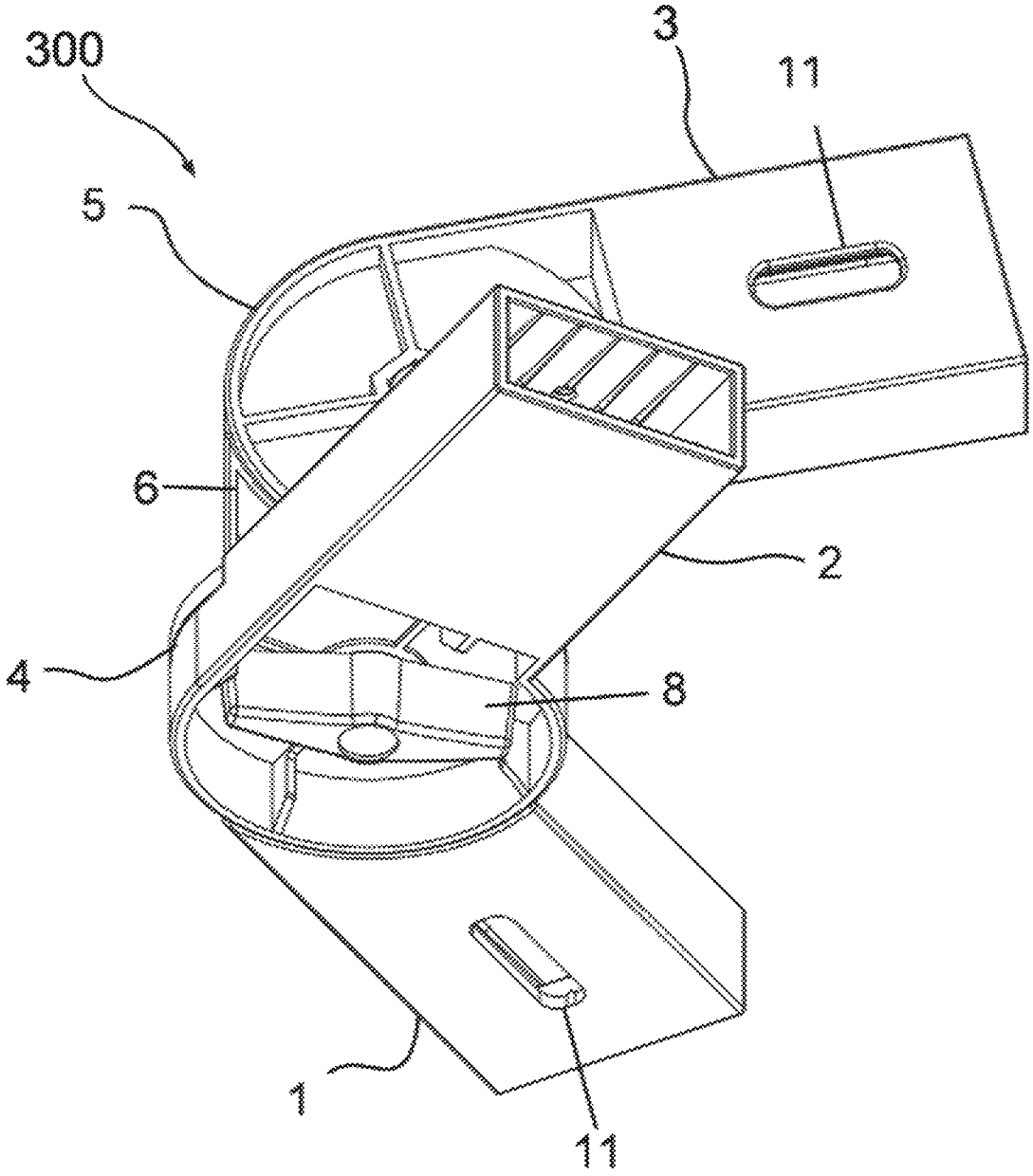
FIG. 7 shows a reverse isometric view of the connector shown in FIG. 7.
Figure 8A:
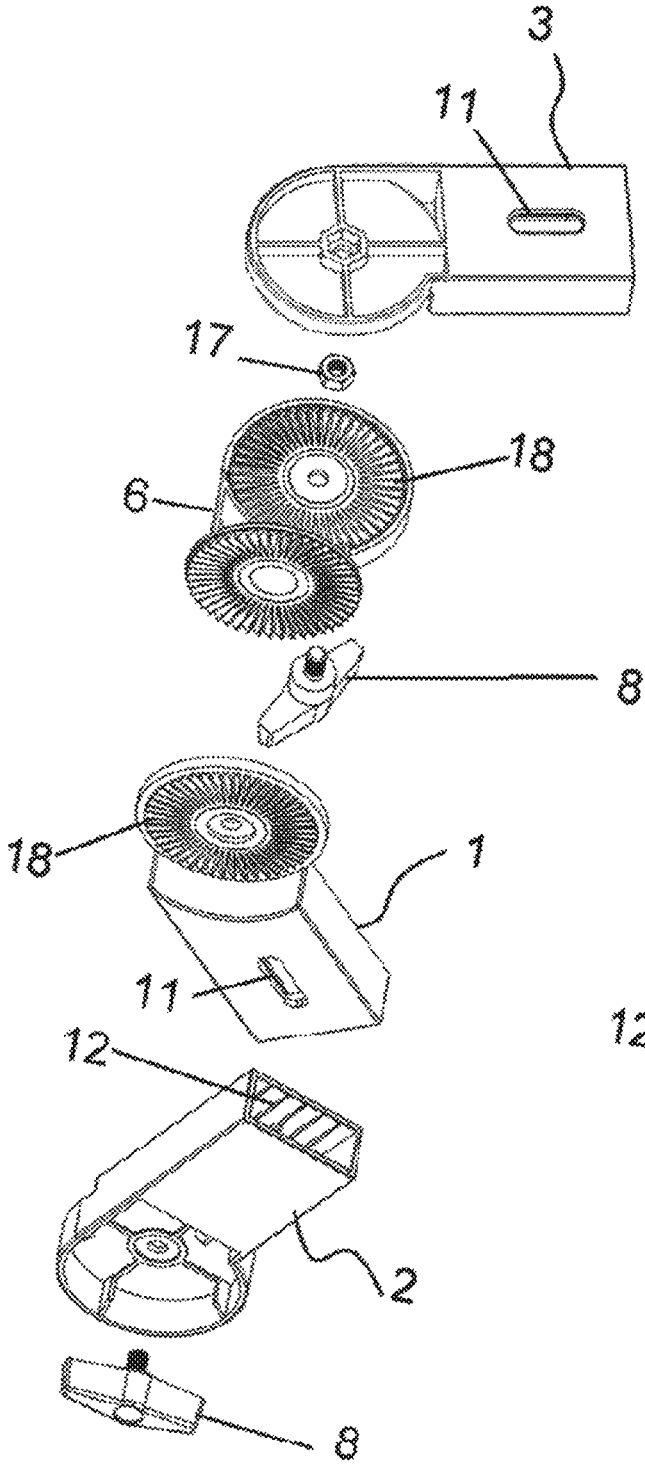
FIGS. 8A and 8B show isometric exploded views of the connector shown in FIGS. 6 and 7.
Figure 8B:
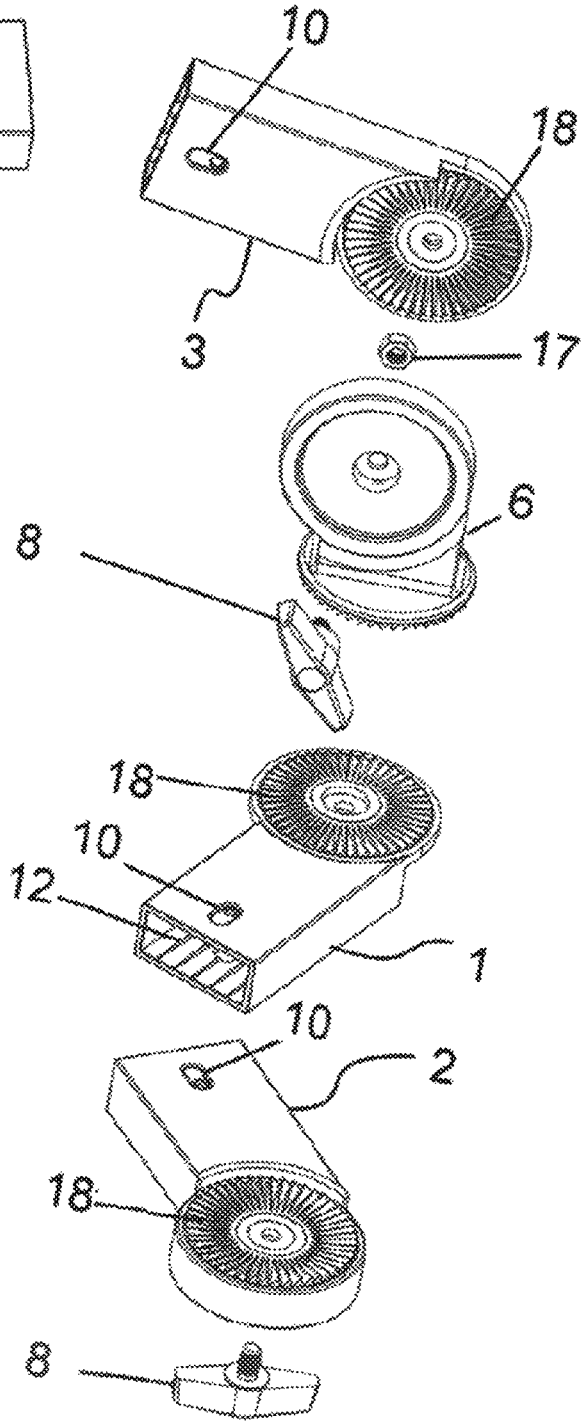

FIGS. 6, 7 and 8 show an adjustable connector 300 with three sockets 1, 2, 3. The first and a second of the sockets 1, 2 are connected by a first articulating joint 4, and third socket 3 is provided on a second joint 5 so that the connector 300 has two points of articulation enabling adjustment of orientation of the sockets 1, 2, 3 in multiple planes. Both articulating joints 4, 5, articulate about a support 6.

A locking means 7, 8 is provided to fix the location of the sockets 1, 2, 3 with respect to each other. The locking means 7 comprises a screw thread and a handle 8, locking in a nut 17 and the joint is provided by two discs which have opposing and contacting circular faces 18 (see FIGS. 8A, 8B).

Such faces 18 are provided with a raised and lowered surface formed by radially extending ribs, wherein an opposed surface on the opposing disc is pushed against the raised and lowered face 18 so as to form a friction lock when the handle 8 is turned clockwise.

In this way the sockets 1, 2, 6 can be rotated relative to the support 6 by means of the articulated joints 4, 5.

Figure 9A:
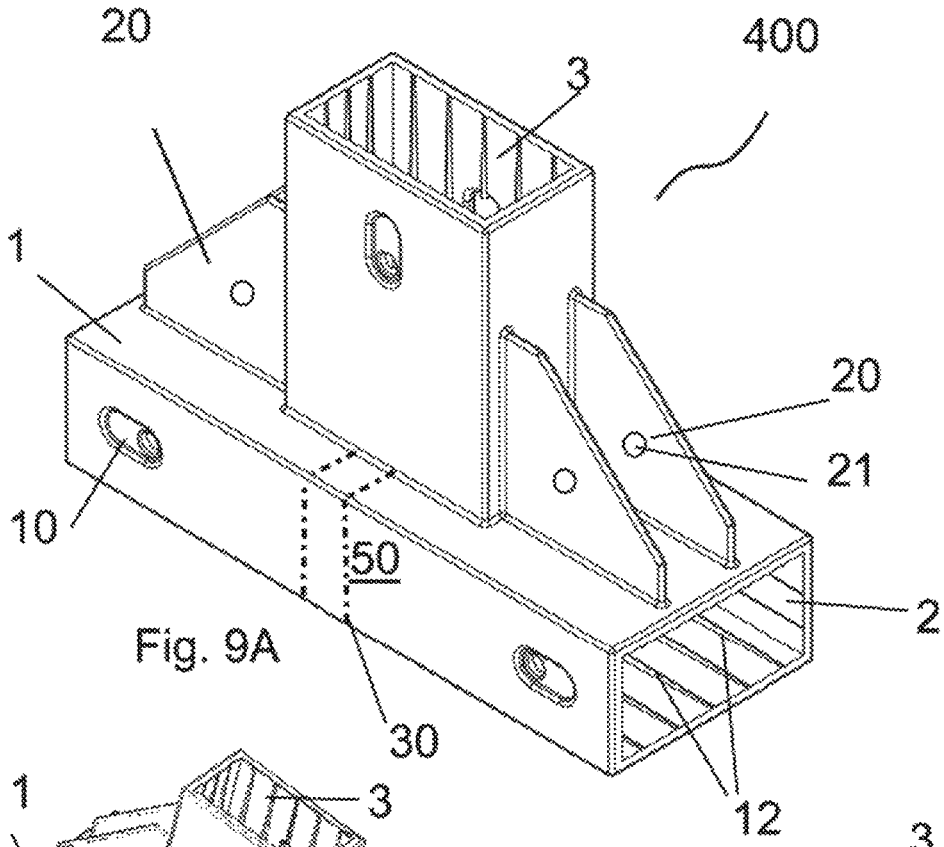
FIGS. 9A, 9B, 9C shows isometric views of a connector with two sockets.
Figure 9B:
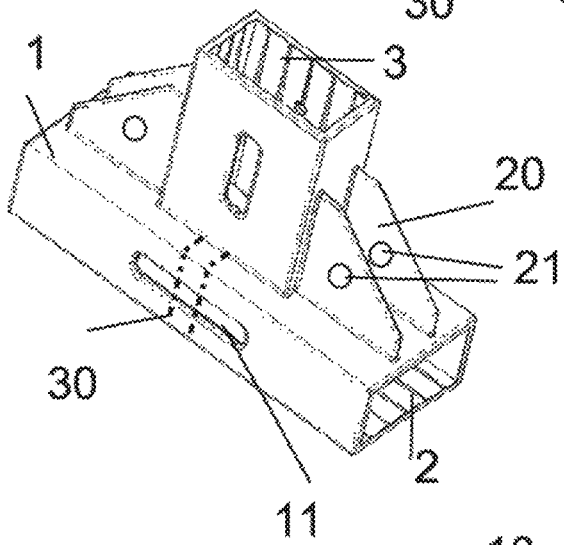
Figure 9C:
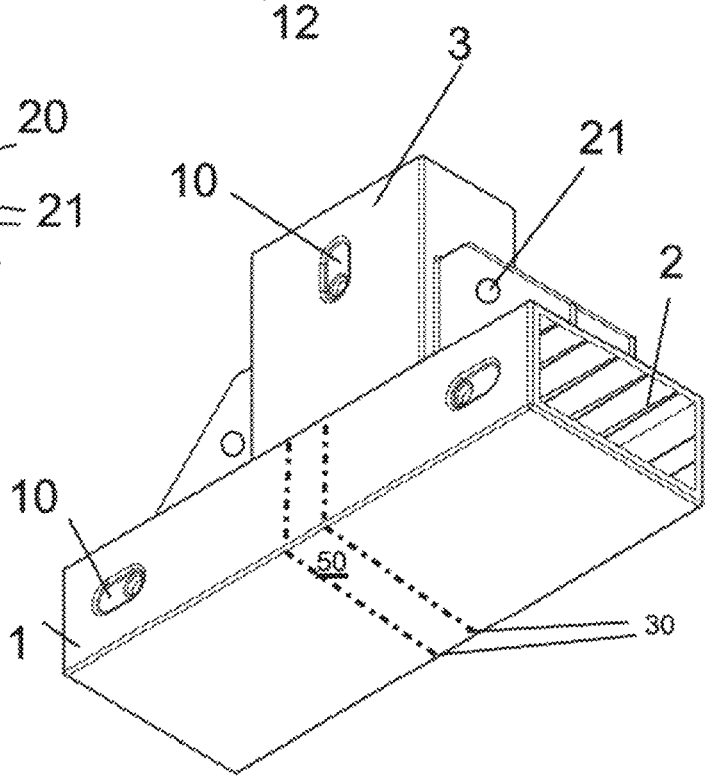

FIGS. 9A, 9B and 9C disclose a T-shaped connector 400 which has a rectangular hollow body 50 with a first socket 1 at one end and a second socket 2 at the opposing end. From one of the larger (wider) sides of the body 50 a third socket extends orthogonally on the body 50. The third socket 3 extends from a central point on the body 50.

This third socket 3 includes substantially triangular guides 20 to either side. On the third socket 3 on the wider sides there are provided a slot 11 on one side and a hole 10 on the opposed side.

Figure 10:
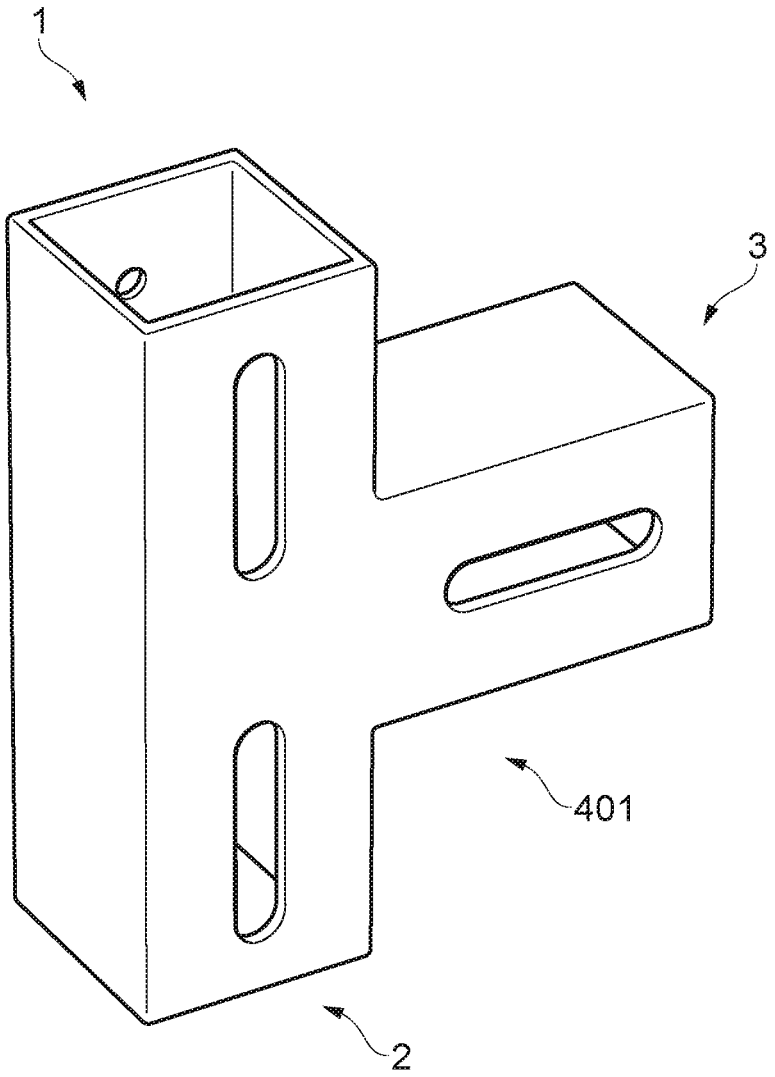
FIG. 10 shows isometric views of a sliding T-shaped connector.

FIG. 10 shows an alternative embodiment 401 of the T-shaped connector. The T-shaped connector 401 has square sockets 1, 2, 3 and no ribs in the first and second sockets 1, 2 so that a length of material can slide through to a selected position. The third socket 3 includes ribs 12 (not visible in this orientation) to enable a length of material to be gripped within the socket 3.

Figure 11A:
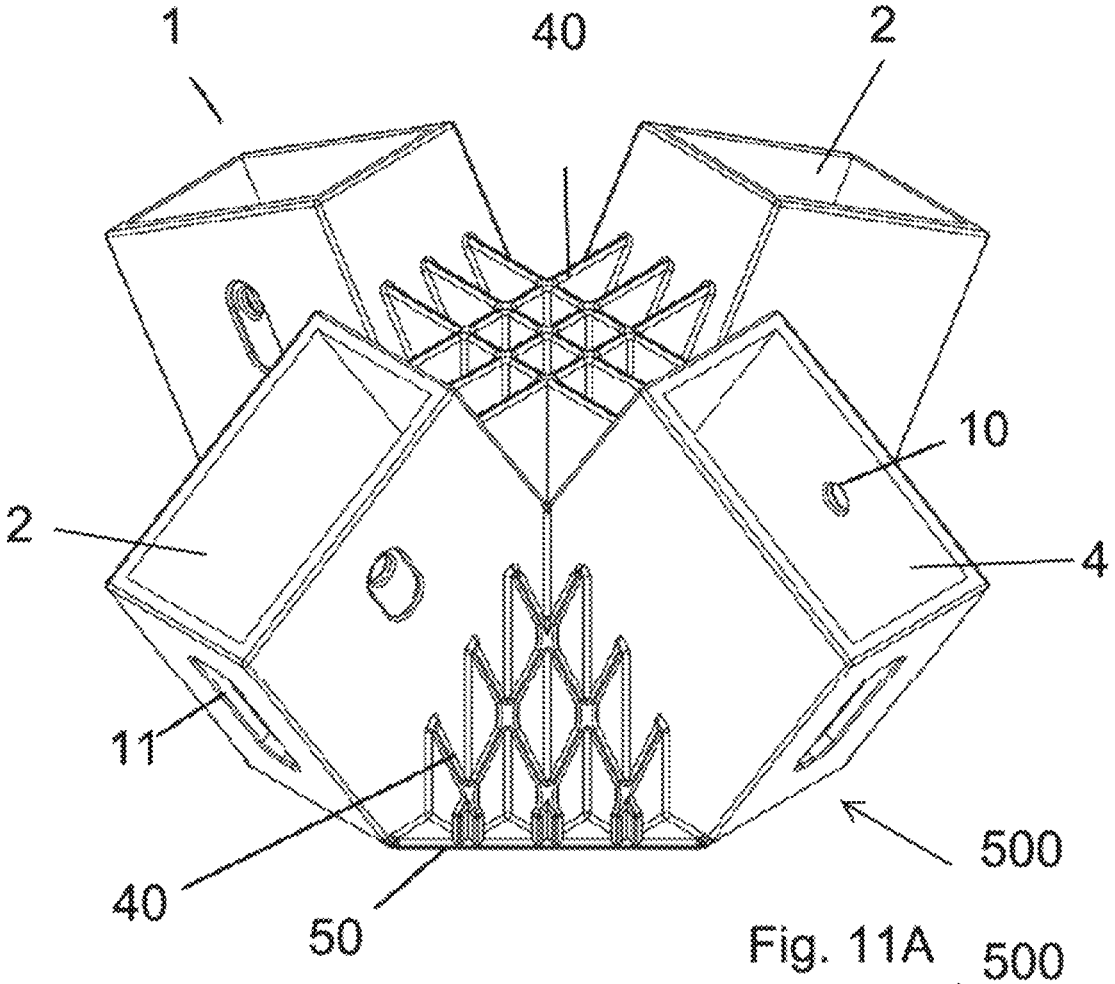
FIGS. 11A and 11B shows isometric views of a connector with four sockets.
Figure 11B:
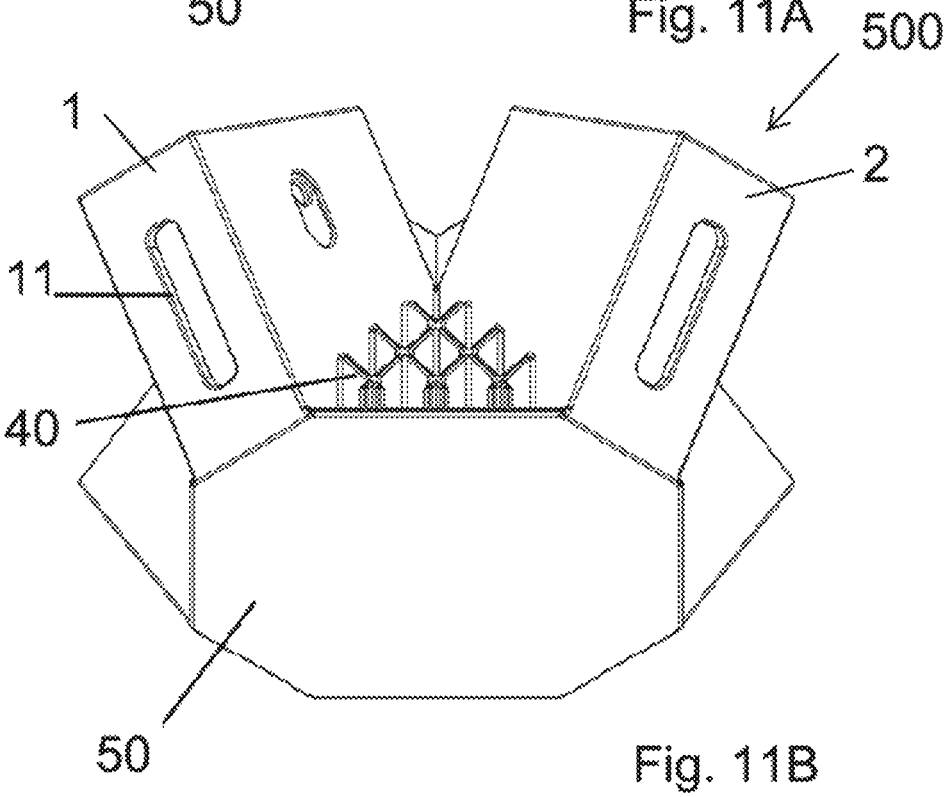
Figure 12:
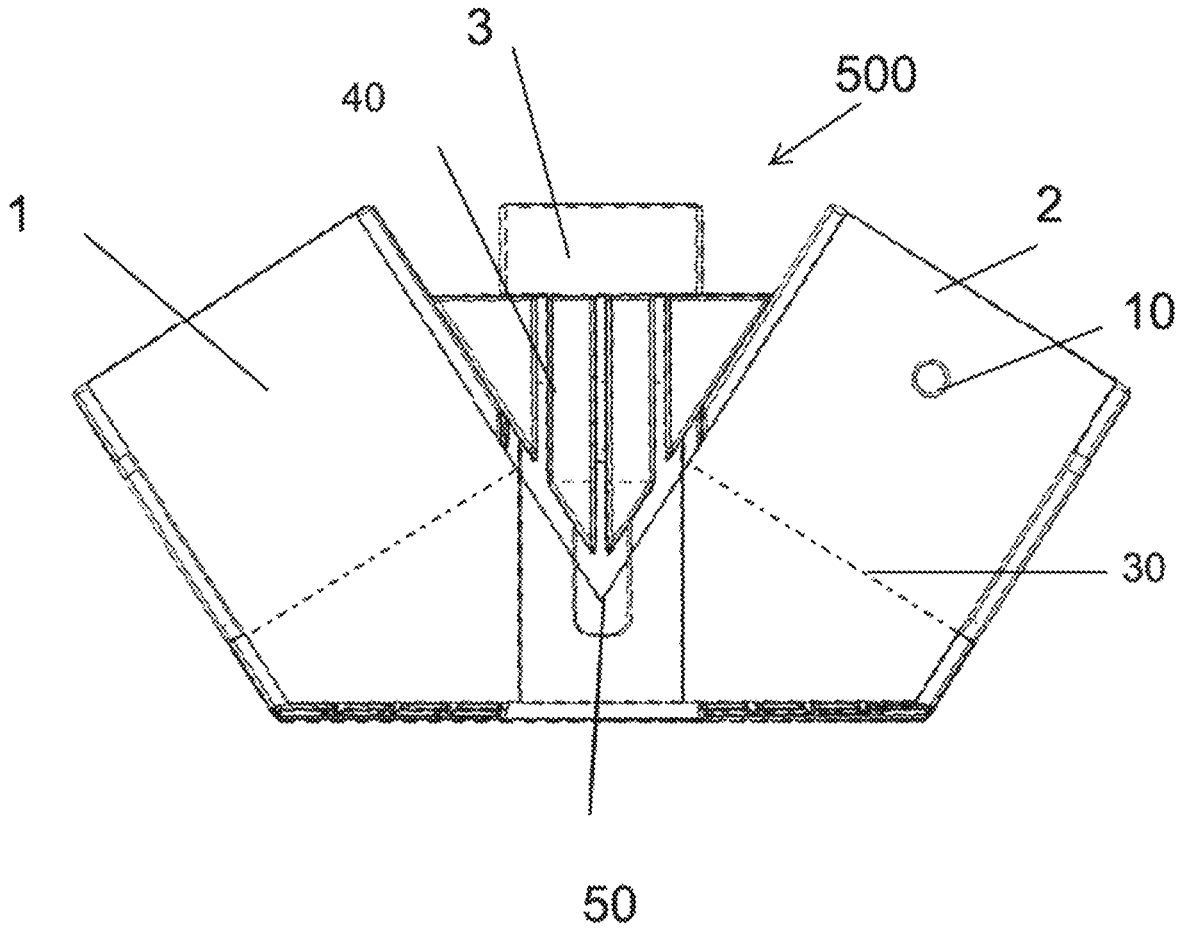
FIG. 12 shows a sectional view of the connector shown in FIGS. 11A, 11B.

FIGS. 11A, 11B and FIG. 12 show a connector 500 with four sockets 1, 2, 3, 4 extending away from a flat octagonal body 50. The sockets 1, 2, 4, 5 extending at 45 degrees (and may be made at any angle) from the body 50. The connector 500 has grids 40 to provide support between adjacent sockets 1, 2, 3, 4.

The narrow sides of the sockets 1, 2, 3, 4 have slots 11 and one of the larger sides has a hole 10.

FIGS. 13A, 13B, 14A and 14B show straight connectors 600, 601 with two sockets 1, 2, one at each opposed end.

Figure 13A:
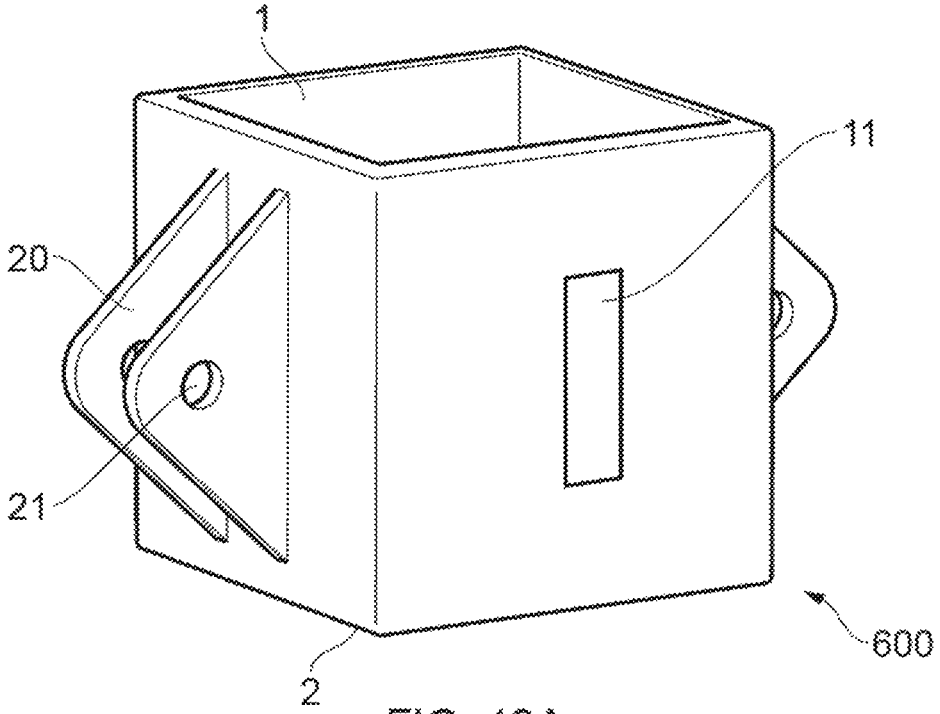
FIGS. 13A and 13B show a sliding connector with two sockets and including guides.
Figure 13B:
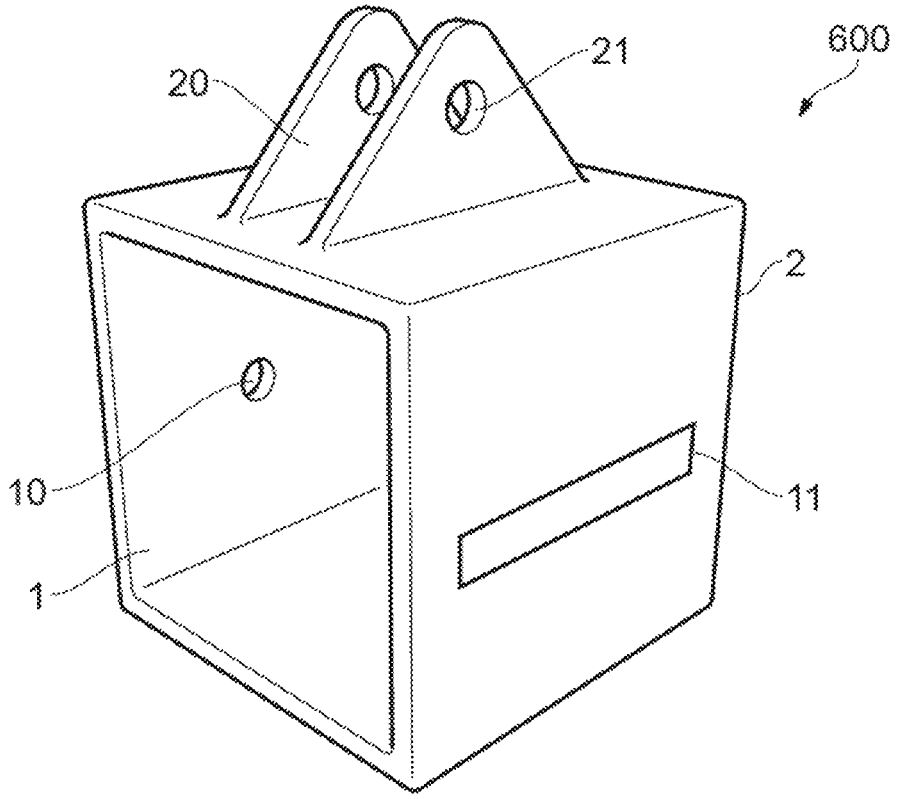

The embodiments shown in FIGS. 13A and 13B show a sliding connector 600 that can be slid along a length of material to a desired position to provide additional guides 20 to support a sheet of material. The pictured embodiment has pairs of guides 20 and each guide has an aperture 21. The sliding connector 600 has no internals ribs and no stopper, so that the length of material is free to pass through without hinderance.

Figure 14A:
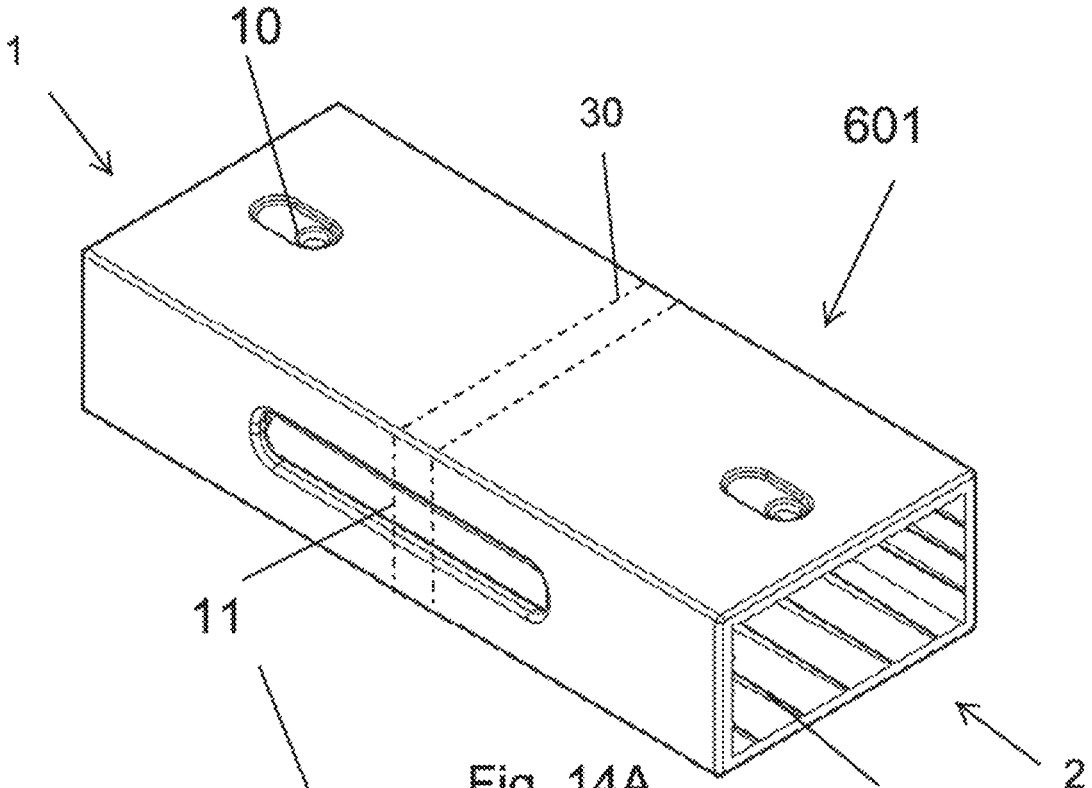
FIGS. 14A and 14B show isometric views of a sliding connector with two sockets.
Figure 14B:
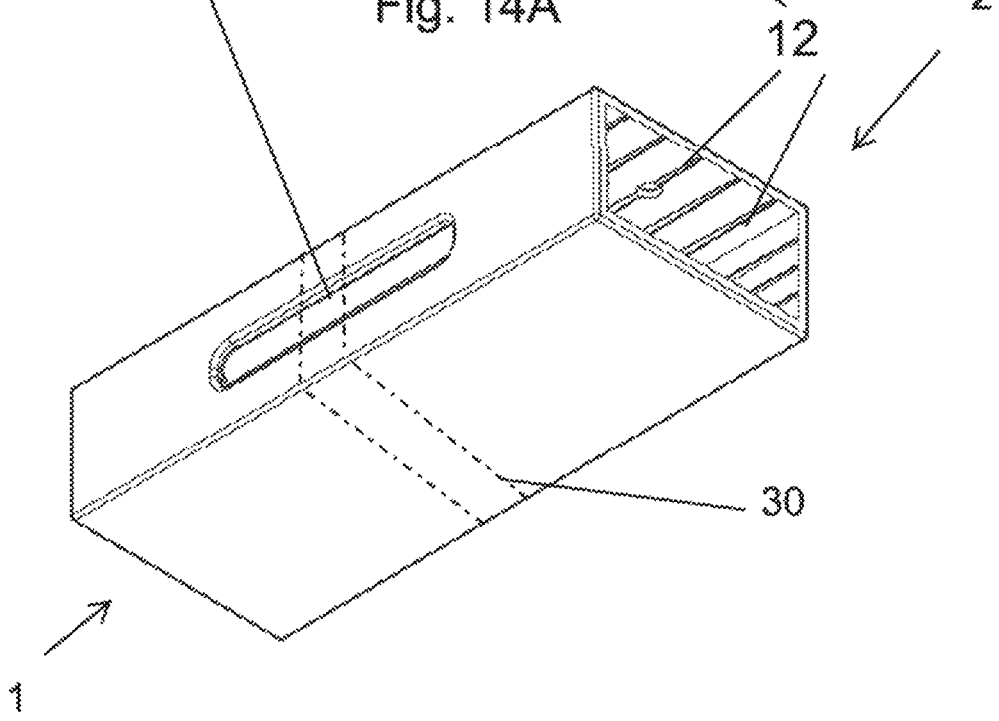

FIGS. 14A and 14B enable two separate lengths of material to be joined by using two separate holes 10, one at each socket 1, 2.

FIGS. 9A, 9B, 9C, 12, 14A and 14B include a dashed line 30 to indicate where stoppers 30 may be positioned within the body 50 to stop the length of material passing through the sockets 1, 2 and providing a surface against which the end of the length of material is located. The stopper 30 may be a plate, or a raised ridge or lip to prevent the length of material from passing through.

The invention has been described by way of examples only and it will be appreciated that variation may be made to the above-mentioned embodiments without departing from the scope of protection as defined by the claims.

What is claimed is:

1. A connector consisting of:

a body having at least one guide projecting outwardly therefrom configured to receive an edge of a sheet of a first material and at least two sockets each having an opening configured to receive an end of a length of a second material, each socket opening in a different direction; and at least one elongated slot extending axially along a first wall of each socket configured to permit a tool to be inserted through the at least one slot to engage the second material, and at least one hole extending through a second wall of each socket configured to receive a securing means that prevents axial movement of the length of the second material.

2. A connector comprising:

a body with at least one guide projecting outwardly therefrom configured to receive an edge of a sheet of a first material and at least two sockets each having an opening configured to receive an end of a length of a second material, each socket opening in a different direction and having at least one rib extending axially along an inner surface thereof; and at least one elongated slot extending axially along a first wall of each socket configured to permit a tool to be inserted through the at least one slot to engage the second material, and at least one hole extending through a second wall of each socket configured to receive a securing means that prevents axial movement of the length of the second material.

3. The connector according to claim 2 wherein the at least one guide is at least two parallel sections that define one or more channels for holding the edge of the first material.

4. The connector according to claim 2 wherein the at least one guide has at least one aperture for receiving the securing means.

5. The connector according to claim 2 formed as a single part.

6. The connector according to claim 2 formed from a synthetic plastics or a recycled synthetic plastics.

7. The connector according to claim 2 wherein the at least two sockets project at different angles from the body.

8. The connector according to claim 2 wherein the body has at least one articulated joint to adjust an angle between the at least two sockets.

9. The connector according to claim 2 wherein a sectional profile of each of the at least two sockets is rectangular.

10. The connector according to claim 2 wherein a sectional profile of each of the at least two sockets is square.

11. The connector according to claim 2 wherein a sectional profile of each of the at least two sockets is round.

12. The connector according to claim 2 wherein the opening of each of the at least two sockets is tapered.

13. The connector according to claim 2 wherein each rib includes a varying depth.

14. The connector according to claim 2 wherein each of the at least two sockets or the body includes a stopper plate to limit entry of the end of the second material into each socket.

15. The connector according to claim 2 wherein each of the at least two sockets or the body includes a stopper ridge to limit entry of the end of the second material into each socket.

16. The connector according to claim 8 wherein the at least one articulated joint has a locking means to lock the angle between the at least two sockets.

17. The connector according to claim 8 wherein the at least one articulated joint has two contacting surfaces that each have a raised surface, a lowered surface, and a tightening means to bring the two contacting surfaces together so that the two contacting surfaces engage and cannot articulate with respect to each other.

18. A kit of parts including at least two said connectors according to claim 2, at least one said first material, and at least one said second material.

* * * * *